US005330070A

United States Patent [19]

Gerhard et al.

[11] Patent Number: 5,330,070

[45] Date of Patent: Jul. 19, 1994

[54] TANK CONTAINER HAVING AN ARMATURE BOX

[75] Inventors: Till Gerhard, Mudersbach; Dieter Pfau, Elkenroth, both of Fed. Rep. of Germany

[73] Assignee: Westerwaelder Eisenwerk Gerhard GmbH, Weitefeld, Fed. Rep. of Germany

[21] Appl. No.: 155,180

[22] Filed: Nov. 19, 1993

[30] Foreign Application Priority Data

Nov. 23, 1992 [DE] Fed. Rep. of Germany ... 9215881[U]

[51] Int. Cl.[5] ..... B65D 7/14

[52] U.S. Cl. ..... 220/562; 220/1.5; 220/724

[58] Field of Search ..... 220/562, 565, 1.5, 465, 220/724

[56] References Cited

U.S. PATENT DOCUMENTS

| | | | |
|---|---|---|---|
| 1,156,469 | 10/1915 | Dodge | 220/724 |
| 2,189,945 | 0/0000 | Fitch | 220/562 |
| 2,256,673 | 9/1941 | Hansen | 220/565 X |
| 3,323,541 | 6/1967 | Schneider, Jr. et al. | 220/724 |
| 4,065,022 | 12/1977 | Cainaud | 220/1.5 X |
| 4,728,000 | 3/1988 | Gerhard | 220/562 X |
| 4,932,551 | 6/1990 | Thomas et al. | 220/1.5 X |
| 4,961,509 | 10/1990 | Currier | 220/1.5 X |

*Primary Examiner*—Steven M. Pollard
*Attorney, Agent, or Firm*—Evenson, McKeown Edwards & Lenahan

[57] ABSTRACT

For protecting tank armatures 22 against mechanical and chemical influences from the environment, an armature box 25 is provided which is screwed to the container frame 13, 17 and sealed with respect to the tank jacket 10 by means of a permanent-elastic sealing material. The armature box 25 is inserted only after the tank armatures 22 have been mounted and thus does not impede their installation. On account of its rigid connection with the container frame 13, 17, the armature box 25 has a high stiffness.

7 Claims, 2 Drawing Sheets

TANK CONTAINER HAVING AN ARMATURE BOX

BACKGROUND OF THE INVENTION

Transport tanks are provided with armatures, such as filling and discharging valves which are attached to the tank jacket and are sometimes expensive and sensible and which must be protected against external influences and unauthorized manipulation. Risks resulting from damaged or torn-off armatures are considerable, particularly when hazardous goods are transported. It is therefore common to protect such armatures by a surrounding armature box which is mounted on the tank jacket and closed by a flap.

Armature boxes of this type must offer sufficient protection against salt water from the road, sea water, spilled aggressive liquids and other obnoxious environmental influences, on the one hand, and shocks from sharp-edged objects (such as fork lift prongs, crane harnesses) and other mechanical influences, on the other hand. Moreover, they should be as light-weight as possible to avoid an unnecessary increase of the tare weight of the tank.

Conventional armature boxes which are either fixedly welded to the tank jacket or are mounted on reinforcing plates that are in turn welded on the tank jacket, meet the above requirements only insufficiently. In most cases, they are formed as thin-walled sheet metal boxes and therefore provide but unsatisfactory protection against mechanical damage. Where massive steel-tube structures are employed, they increase the tare weight of the tank.

A further disadvantage of common armature boxes resides in the fact that they cause undesired additional thermal stress on the tank when welded to the tank jacket, or involve additional manufacturing costs when mounted on reinforcing plates.

To save weight, and in view of the limited space available, armature boxes should be as small as possible. As a result, they surround the armatures relatively closely which in the prior art results in the further difficulty that they impede the installation of the armatures.

SUMMARY OF THE INVENTION

It is an object of the invention to provide a tank container having an armature box which avoids disadvantages of conventional constructions and, more specifically, provides effective protection, specifically also against mechanical influences, while having little weight of its own, does not impede the installation of the armatures, is insensitive to tolerances and can be mounted without stressing the tank jacket.

This object is met by a tank container which comprises a tank having a tank jacket, a frame at least partially surrounding the tank, armatures protruding from the tank jacket, and an armature box located within the profile of the tank container defined by the frame and surrounding the armatures, wherein the armature box is fixed to the frame and has an opening facing the tank, the opening having a peripheral region which is sealed with respect to the tank jacket.

The armature box is thus fixed to the frame rather than to the tank jacket and is open towards the tank jacket. Mounting the armature box on the frame provides the box with sufficient stiffness to withstand considerable mechanical impacts even if made of comparatively thin sheet metal.

On account of the further fact that the armature box is not rigidly connected—specifically not welded—to the tank jacket itself, stress on the tank jacket is avoided. In the prior art, such stress occurs when the armature box, or a reinforcing plate carrying the same, is welded to the tank jacket. Further stress may conventionally result from the fact that a rigidly mounted armature box prevents the tank jacket from undergoing elastic deformation where exposed to heavy impacts.

Because the armature box according to the invention is not rigidly connected to the tank jacket, there is no need for the box to be mounted prior to the installation of the armatures and therefore the box does not impede the installation work even though it closely envelopes the armatures as usual. In the prior art, a subsequent fitting of an armature box is impossible because the tank, including all portions fixedly connected to it, must be coated or painted before the armatures may be installed.

In a preferred embodiment, permanent-elastic sealing material is inserted between the armature box opening and the tank jacket. The permanent-resilient material provides sufficient protection against chemical influences while at the same time permitting small relative movements between the tank jacket and the armature box, as are desirable to compensate differences in thermal expansion or in case of shock loads.

In another embodiment of the invention, the tank jacket has a cylindrical surface portion defining a tank axis, the peripheral region of the armature box opening facing the cylindrical surface portion, and the armature box has side wall elements extending perpendicularly to the tank axis and a wall element extending between the tank jacket and the frame parallel to the tank axis and being detachably connected to the side wall elements. The armature box may thus be premanufactured (with the exception of one wall element) and inserted between the tank jacket and the container frame in such a way that it closely abuts the frame and the tank, after the armatures have been mounted and irrespective of tolerances, which are unavoidable in the manufacture and mounting of the tank.

Other preferred embodiments of the invention are provided with measures to compensate larger tolerances, and achieve an armature box with very good overall stiffness even if made of comparatively thin sheet metal.

DETAILED DESCRIPTION OF A PREFERRED EMBODIMENT

Figure 2:
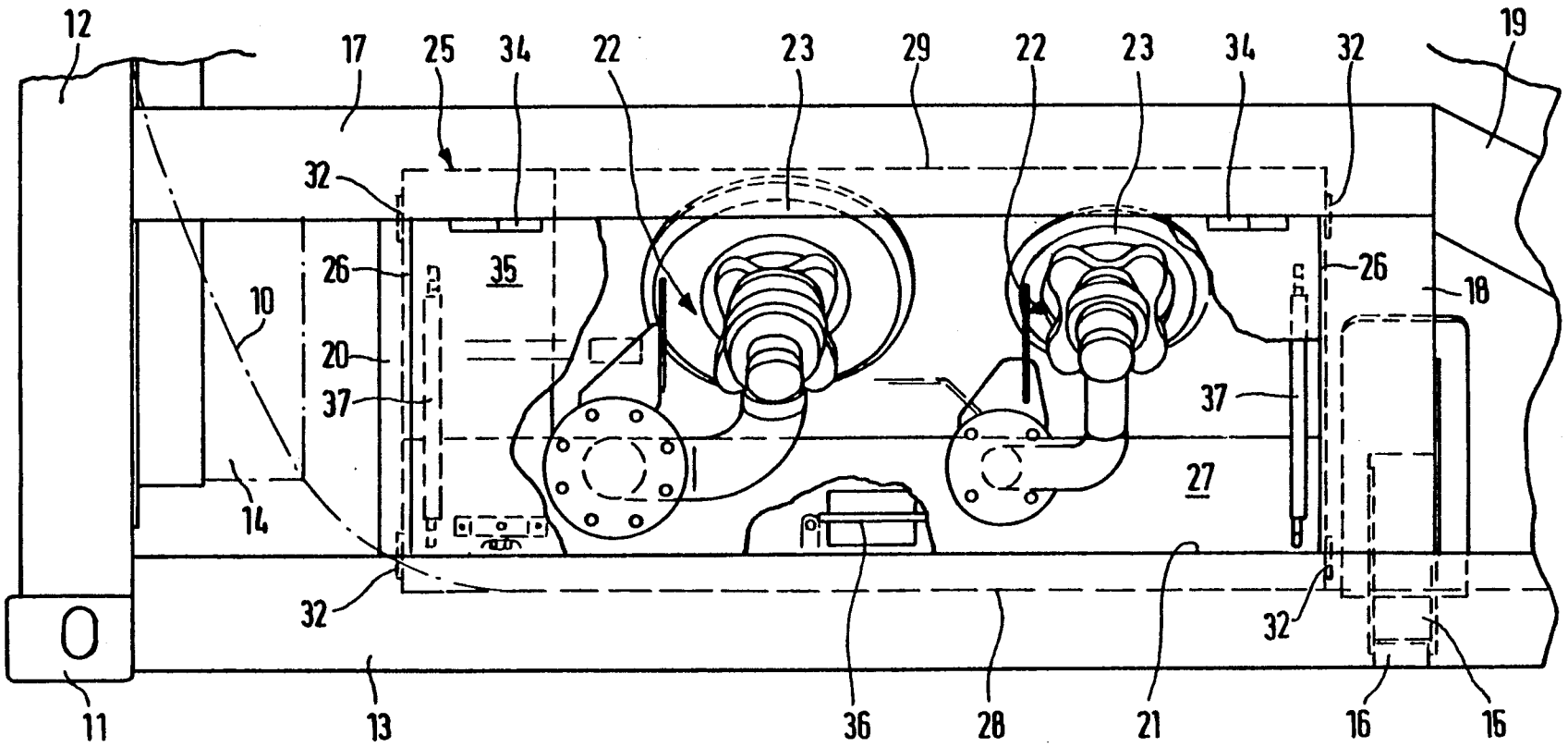
FIG. 2 is a side view taken in the direction of the arrow II of FIG. 1.

The drawings show a lower corner region of a tank container in which the tank jacket is designated 10 and a lower corner fitting 11, a corner upright 12 and a lower longitudinal bar 13 are seen as parts of the container frame. The corner upright 12 is part of an end frame which supports tank through an annular saddle 14 connected to the tank head, as indicated in FIG. 2. The tank is further supported at an intermediate location in the longitudinal direction, via a transverse saddle 15 by a lower transverse bar 16 of the frame.

As appears from FIG. 2, a short intermediate longitudinal bar 17 is inserted in the corner region of the frame illustrated. The bar 17 has its left-hand end in FIG. 2 welded to the corner upright 12 and its right-hand end connected to the lower longitudinal bar 13 by means of a short vertical strut 18. For further stabilization, the corner formed by the longitudinal bar 17 and the strut 18 may be connected to the lower longitudinal bar 13 by a diagonal strut 19. A further vertical strut 20 is inserted between the longitudinal bars 13, 17 and co-operates with the frame members 13, 17 and 18 to define a rectangular window 21.

Tank armatures are shown in the drawings in thin lines and designated as a whole by 22. Two valves of different cross-sections have been illustrated with their associated connecting pipes, actuation members and stop gates. Each valve has a mounting flange 23 resting on the tank jacket 10.

Figure 1:
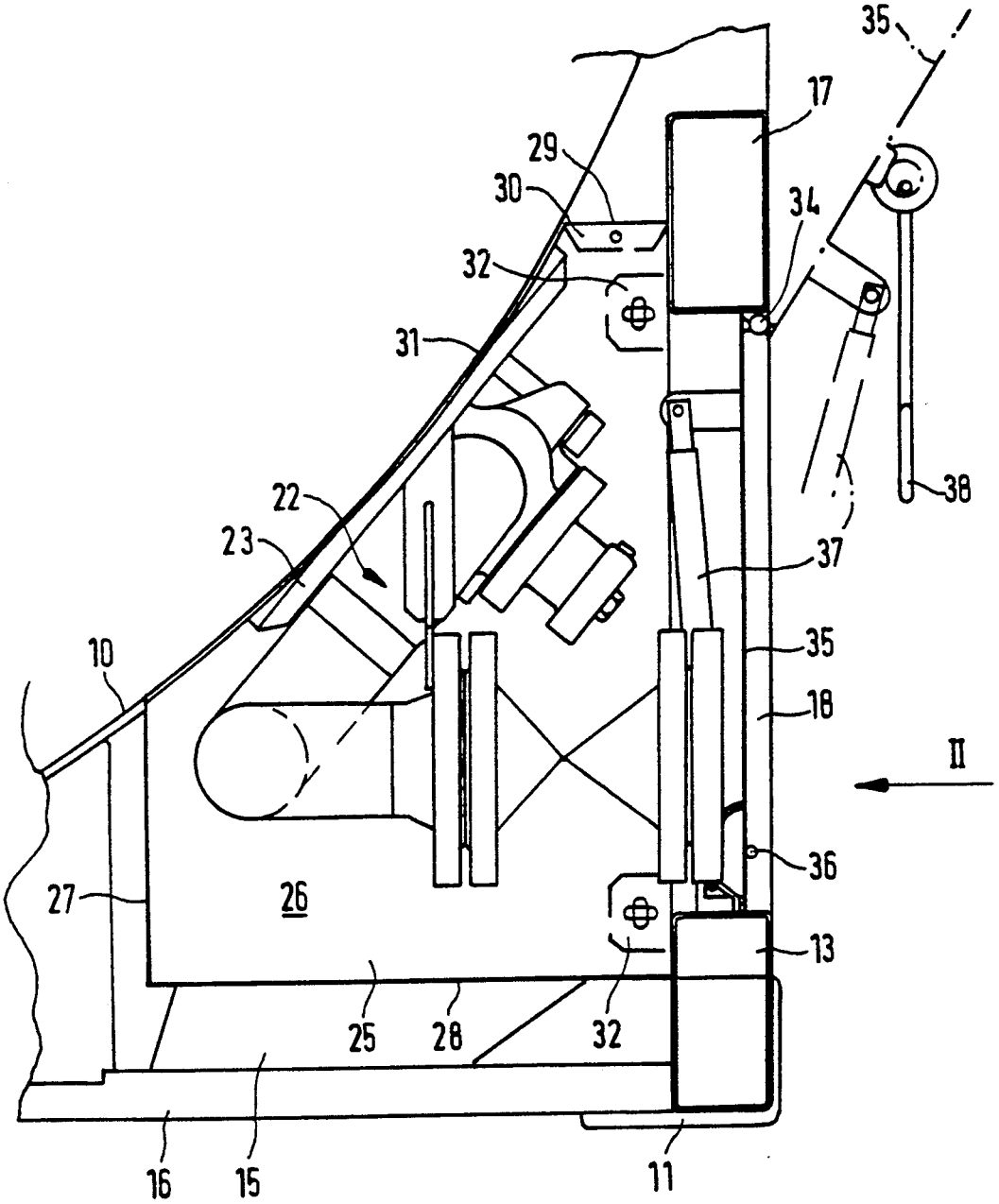
FIG. 1 shows a partial section taken in a plane extending perpendicular of the tank axis through the lower region of a tank container with an armature box provided there.

The armatures 22 are surrounded by an armature box 25 which is formed by two somewhat trapezoidal side wall elements 26 extending perpendicularly to the tank axis, a rear wall element 27 which is remote from the longitudinal bars 13, 17, a bottom wall element 28 and a narrow upper wall element 29. The wall elements 26, 27 and 28 are formed from one continuous blank and interconnected by bending and welding. The upper wall element 29 has its short edges provided with flanges 30 which are screwed to the side wall elements 26. As shown in FIG. 1, each side wall element 26 has a concave curved edge 31 cut to follow the profile of the tank jacket 10.

As appears from FIG. 2, the outward opening of the armature box 25 is larger than the window 21 formed by the frame elements 13, 17, 18 and 20. Rearwardly projecting brackets 32 are welded to the vertical struts 18 and 20 and are provided with vertically extending oblong holes. In the same area, the side wall elements 26 of the armature box 25 have horizontally extending oblong holes. A screw extends through each pair of oblong holes to fasten the box 25 to the container frame.

Provided at the lower surface of the intermediate longitudinal bar 17 are hinges 34 for a flap 35 which is so dimensioned that it just fits into the window 21. In its lower middle region, the flap 35 is provided with a handle 36 for opening the flap. The opening action is assisted by two gas compression springs 37 which hold the flap 35 in the open position in which it extends upwardly and outwardly, as shown in phantom lines in FIG. 1. The gas compression springs 37 engage the flap 35 in such a manner that they pass their position of shortest length when the flap is being closed, so that they bias the flap 35 also into its closed position. A hoop 38 is loosely articulated at the inner side of the flap 35 to facilitate the closing of the flap.

In assembly, the tank is first placed in the container frame via the saddles 14, 15 and welded thereto, and the thus formed structural unit is painted. The tank armatures 22 are then installed.

Subsequently, the pre-fabricated armature box 25, which has not yet been provided with the upper wall element 29, is inserted between the tank and the frame from below and is screwed to the frame at the brackets 32. Tolerances are compensated by the oblong holes so that the armature box 25 can always be brought into such a position that it closely abuts the inner surfaces of the frame members 13, 17, 18 and 20 and that its curved edge 31 reaches the tank jacket 10. The upper wall element 29 is then placed in position and screwed with its flanges 30 to the side wall elements 26.

Finally, the peripheral portion of the armature box 25 formed by the curved edges 31 and the edges of the rear wall 27 and the upper wall element 29 is sealed with respect to the tank jacket 10 by means of a permanent-elastic sealing material (not shown).

We claim:

1. A tank container comprising a tank having a tank jacket, a frame at least partially surrounding the tank, armatures protruding from said tank jacket, and an armature box located within the profile of the tank container defined by the frame and surrounding said armatures, wherein the armature box is fixed to the frame and has an opening facing the tank, said opening having a peripheral region which is sealed with respect to said tank jacket.

2. The tank container of claim 1, including permanent-elastic sealing material inserted between the peripheral region of said armature box opening and said tank jacket.

3. The tank container of claim 1, wherein said tank jacket has a cylindrical surface portion defining a tank axis, the peripheral region of said armature box opening facing said cylindrical surface portion, and said armature box having side wall elements extending perpendicularly to said tank axis and a wall element extending between said tank jacket and said frame parallel to said tank axis and being detachably connected to said side wall elements.

4. The tank container of claim 3, wherein said side wall elements of the armature box are screwed to brackets provided on said frame, at least one of said brackets and said side wall elements being provided with an oblong hole the longer axis of which extends substantially parallel to an inner frame surface facing the tank.

5. The tank container of claim 4, wherein the other one of said side wall elements and said brackets is provided with an oblong hole the longer axis of which extends substantially perpendicularly to said inner frame surface facing the tank.

6. The tank container of claim 1, wherein the frame includes four frame members forming a window and confining said armature box at its side remote from the tank.

7. The tank container of claim 6, comprising a flap pivotally supported by one of said frame members for closing said window.

* * * * *